US007507133B2

(12) United States Patent
Cheung

(10) Patent No.: US 7,507,133 B2
(45) Date of Patent: Mar. 24, 2009

(54) FOAM DECK COMPOSITE SURFBOARD

(76) Inventor: Wah Kan Cheung, 55 Doncaster Ave., Suite 102, Richmond Hill (CA) L3T 1L7

( * ) Notice: Subject to any disclaimer, the term of this patent is extended or adjusted under 35 U.S.C. 154(b) by 353 days.

(21) Appl. No.: 11/326,179

(22) Filed: Jan. 5, 2006

(65) Prior Publication Data

US 2007/0155261 A1 Jul. 5, 2007

(51) Int. Cl.
*B63B 35/81* (2006.01)

(52) U.S. Cl. ..... 441/65; 441/74; 114/357

(58) Field of Classification Search ..... 441/65, 441/74; 114/357

See application file for complete search history.

(56) References Cited

U.S. PATENT DOCUMENTS

2006/0134401 A1* 6/2006 Yeh ..... 428/316.6

* cited by examiner

*Primary Examiner*—Ed Swinehart
(74) *Attorney, Agent, or Firm*—Clement Cheng

(57) ABSTRACT

A polyethylene foam composite surfboard comprises a longitudinally extending foam core having a top surface, a bottom surface and rail surfaces. A top laminate is bonded to the top surface and rail surfaces. A bottom laminate bonded to the bottom surface. The top laminate or the bottom laminate comprises (a) a polyolefin foam layer having an inner surface and outer surface;(b) a non-woven fabric layer having a first hot melt resin coated surface and a second uncoated surface opposed to the resin coated surface, of which the hot melt resin coated surface is bonded to the inner surface of the polyolefin foam; and (c) a reinforcement layer comprising fiberglass laminate impregnated with polymer resin and having an inner surface and outer surface. The outer surface is bonded to the uncoated surface of the non-woven fabric and the inner surface is bonded to the foamed surface of the core.

13 Claims, 9 Drawing Sheets

FOAM DECK COMPOSITE SURFBOARD

BACKGROUND OF THE INVENTION

A. Field of the Invention

The present invention relates generally to polyolefin foam deck soft surfboard, more particularly, to polyethylene foam deck soft surfboard having a hot melt resin layer disposed on the polyethylene foam sheet for bonding the polyethylene foam sheet to a non-woven fabric sheet.

B. Description of the Prior Art

Soft deck surfboards have become very popular in recent years. A soft deck surfboard is particularly suitable and safe for beginner surfer because the board is made of foam material and lightweight. The injury caused by surfing on a soft deck surfboard is relatively minor compared to a hard skin fiberglass surfboard if the surfboard accidentally hits the rider. Soft deck surfboards are typically constructed of a semi-flexible foam core, a plastic slick bottom skin and a polyethylene foam deck skin. The foam core may include polyethylene foam, polypropylene and polystyrene foam. Polyethylene foam sheet is generally used for the foam skin on the deck due to its resilient and non-slip properties. One problem with such boards, however, is that the soft surfboards normally suffer from the lack of rigidity, which is necessary for proper surf control. In many cases, one or more longitudinal struts are placed inside foam core of soft surfboards to provide structural support and increase stiffness. These stringers may comprise wood, epoxy/fiberglass composite, polymer resin material or some other high-strength, resilient, and fairly lightweight material.

Small size wave surfing boards having a hard surface composite foam core have been used for many years. The composite foam board generally includes a polyurethane foam core with opposing skins comprised of fibrous reinforcing mats or fabrics in a matrix of cured resin. These composite foam boards have been manufactured as different size, shape and rocker configuration suitable for a particular surfing sports and may be used as a skimboard, wakeskate board or wake surfboard. One deficiency of these conventional hard surface composite foam boards is that resin-casted surface is slick to a rider's foot. As a result, wax or a foam pad made of high frictional foam material is generally applied to the deck of the surfing boards to increase the traction. It is therefore desirable to provide foam deck soft surfboard having a non-slip and resilient foam skin which does not require the application of wax or an externally attached foam pad.

U.S. Pat. No. 4,695,501 discloses a thermoformable composite article of foam adhesively laminated by top and bottom fabric layers with at one fabric layer made of a non-woven fabric impregnated with a thermoplastic or thermosetting resin. The reference shows foam particularly well suited in furnishing automobile interiors.

In view of the foregoing shortcomings of the prior art, it is the primary objective of the present invention to provide a soft deck surfboard having improved stiffness. Another objective of the present invention is to provide an improved surfboard having a soft deck with improved stiffness and at the same time retain the lightweight foam core and the non-slip and resilient foam skin. Another objective of the present invention is to provide a manufacturing process that is inexpensive to make surfboards and resulting articles of manufacture having improved stiffness while maintaining light weight.

SUMMARY OF THE INVENTION

The surfboard of the present invention is generally constructed of a foam core, a laminated top skin covering the top and side rail surfaces of the surfboard, and a laminated bottom skin covering the bottom surface of the foam core. The foam core may have one or more longitudinal stringers embedded therein.

The laminated top skin is made up of four individual layers of material, an outermost layer of polyolefin foam skin, an intermediate hot melt resin layer of polymer resin and two innermost layers, respectively. The outermost layer may be a polyolefin foam sheet, which provides a frictional surface on the deck of surfboard. The polyolefin foam may be homopolymer or copolymer of polyethylene and polypropylene, and may be cross-linked type or non cross-linked type.

The intermediate hot melt resin layer may comprise a member selected from ethylene/alpha-olefin copolymer, ethylene/acrylic acid copolymer, ethylene/vinyl acetate copolymer, ethylene/propylene rubber, blends of the foregoing, or the like. A non-woven fabric sheet may also be used as one innermost layer because it adheres well to conventional casting polymer resin such as polyester, epoxy resin or the like and it also adheres well to the hot melt resin coating layer. Useful non-woven fabric having the required properties includes fibrous material of polyethylene, polypropylene and polyester and a blend of one or more of such fibrous material. The non-woven fabric may be a spun-bonded mat of polyester fiber having a mesh of about 80 g/m$^2$ and thickness uniformity of about 0.8 mm or less.

A reinforcing layer is attached to the foam core by impregnating a desirable casting polymer resin including epoxy, vinyl ester or polyester, more preferable epoxy resin, or the like at the interfaces between the foam core and the non-woven fabric sheet. The reinforcing layer may include inorganic materials such as fiberglass or carbon fiber; or synthetic organic fibers such as urethane fibers, nylon filaments, nylon fabrics, aramid filaments and fabrics, and the like, having thermosetting resin binder system distributed throughout the layer. The reinforcing layer may be in the form of non-woven mat or woven mat. Typically, the reinforcing layer is a non-woven chop strand mat or a woven mat of fiberglass fiber.

The laminated bottom skin is constructed of five layers of material. The four inner layers are the same as the top skin in material and order from the foam core. The bottom skin comprises a fiberglass reinforcement, non-woven fabric sheet, hot melt resin and polyethylene foam sheet corresponding to the top skin which comprises fiberglass reinforcement, non-woven fabric sheet, hot melt resin and polyethylene foam sheet. The outermost layer is a plastic slick film. Possible plastic slick film may include polyethylene, polypropylene, ABS, polycarbonate, acrylic and blends of the foregoing.

The surfboard constructed in accordance with the present invention includes a longitudinally extending central core of relatively soft and light material such as foamed plastic and a laminated top skin construction and a laminated bottom skin construction surrounding the core. Suitable materials for use as foam core include those foamed polymer known in the art. Illustrative materials include polyolefin homopolymers and copolymers such as ethylene, propylene, ethylene/vinyl acetate (EVA). Other useful materials include polyurethane and polystyrene foam. The foam core may be made by molding or extrusion and may be in beaded type, extruded type, cross-linked type or non cross-linked type.

DETAILED DESCRIPTION OF THE PREFERRED EMBODIMENT

Figure 1:
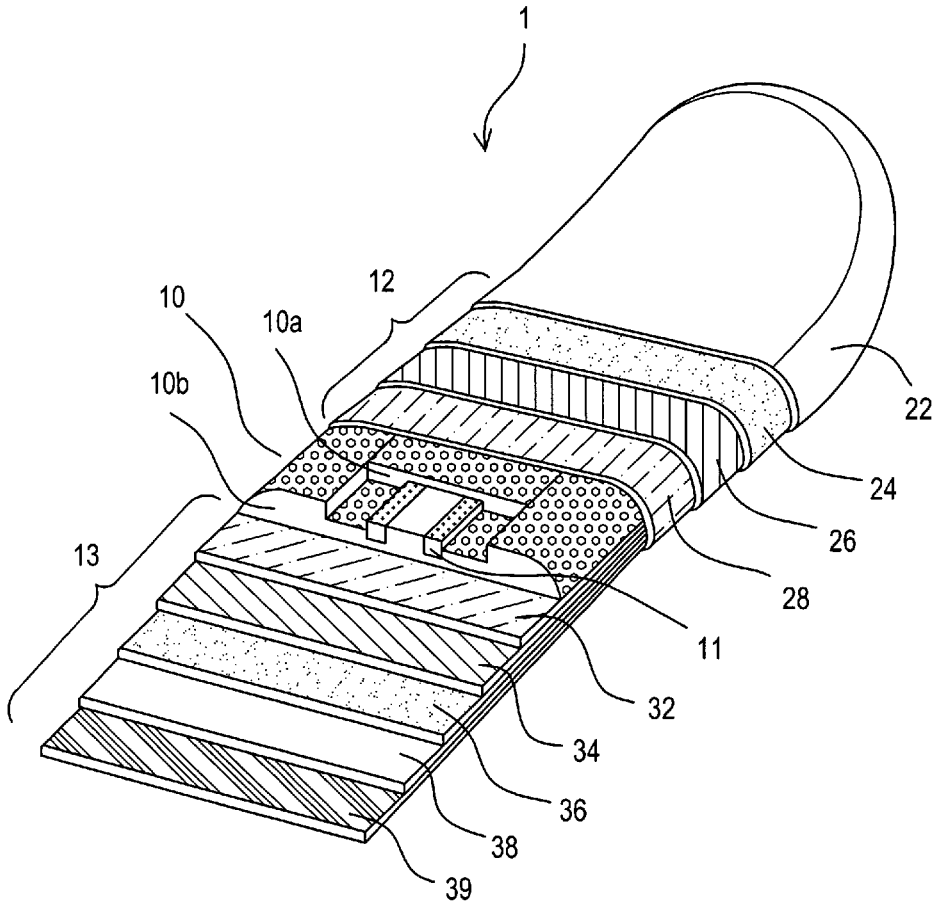
FIG. 1 is a partially exploded perspective view of a surfboard according to a first embodiment of the present invention.

In the preferred embodiment shown in FIG. 1, the surfboard 1 of the present invention is constructed of a foam core 10, a laminated top skin 12 covering the top and side rail surfaces of the surfboard 1, and a laminated bottom skin 13 covering the bottom surface of the foam core 10. The foam core 10 may be made of an upper member 10*a* and a lower member 10*b* having one or more longitudinal stringers 11 enclosed in between. This laminate configuration is located in the middle of the board as seen in figure one.

As best seen in FIG. 1, the laminated top skin 12 construction is made up of four individual layers of material, an outermost layer of polyolefin foam skin 22, an intermediate hot melt resin layer 24 and two innermost layers 26 and 28, respectively. In this first embodiment illustrated, the outermost layer 22 is a polyolefin foam sheet, which provides a frictional and soft surface on the deck of surfboard. The polyolefin foam 22 may be homopolymer or copolymer of polyethylene and polypropylene, and may be cross-linked type or non cross-linked type. Layer 22 has a thickness of between 1 and 10 mm, and preferably a thickness of 4 mm. Layer 22 is preferably a cross-linked polyethylene foam. Layer 22 has a density in the range of 4 to 10 lb/ft$^3$, and preferably a density of 8 lb/ft$^3$.

The intermediate hot melt resin layer 24 can be made of any well-known hot melt adhesive resin capable of forming a strong bond with both non-woven fabric and polyolefin foam including ethylene/alpha-olefin copolymer, ethylene/acrylic acid copolymer, ethylene/vinyl acetate copolymer, ethylene/propylene rubber, and blends of the foregoing. The hot melt resin being ethylene/alpha-olefin copolymer has surprisingly good bonding results and is the best mode. Layer 24 has a thickness of between 0.02 and 0.75 mm, and preferably a thickness of 0.07 mm. The layer 26 is a non-woven fabric sheet. The non-woven fabric should adhere well to conventional casting polymer resin such as polyester, vinyl ester, epoxy resin or the like and it should also adhere well to the hot melt resin coating layer 24. Suitable non-woven fabric having the required properties includes fibrous material of polyethylene, polypropylene and polyester and a blend of one or more of such fibrous material. Layer 26 has a weight of between 30 to 120 g/m$^2$, and preferably a weight of 80 g/m$^2$ and thickness uniformity of about 0.8 mm or less.

The layer 28 is a reinforcing layer comprising one or more layers of fibrous reinforcing mats or fabrics selected from fiberglass, carbon fiber, urethane fibers, nylon filaments, nylon fabrics, aramid filaments and a combination of foregoing. In the preferred embodiment, layer 28 is a non-woven chop strand mat or a woven mat of fiberglass fiber. Layer 28 has a weight of between 80 to 200 g/m$^2$, and preferably a weight of 100 g/m$^2$. The reinforcing layer is impregnated with a desirable thermosetting resin selected from epoxy, vinyl ester or polyester, preferable epoxy resin, or the like. The amount of resin placed on the fibers is not critical as long as it is sufficient to bond them together with sufficient strength to maintain its integrity.

As is also illustrated in FIG. 1, laminated bottom skin 13 is constructed by five layers of material. The four inner layers are the same as the top skin 12 in material and order from the foam core 10. The bottom skin 13 comprises a fiberglass reinforcement 32, non-woven fabric sheet 34, hot melt resin 36 and polyethylene foam sheet 38. Layers 32, 34, 36 and 38 are of the same structure and composition as layers 28, 26, 24 and 22, respectively. Layer 32 has a weight of between 150 to 700 g/m$^2$, and preferably a weight of 250 g/m$^2$. Layer 38 has a thickness of between 1 and 10 mm, and preferably a thickness of 4 mm. Layer 38 has a density in the range of 4 to 12 lb/ft$^3$, and preferably a density of 10 lb/ft$^3$. The outermost layer 39 is a plastic slick film. Preferable plastic slick film 39 may include polyethylene, polypropylene and a blended polymer with other polymer resin. Layer 39 has a thickness of between 0.35 to 2 mm, and preferably a thickness of 1 mm. Layer 39 has a density in the range of 0.91 to 0.98 g/cm$^3$, and preferably a density of 0.95 g/cm$^3$.

The foam core 10 should be constructed of suitable lightweight and strong buoyant material such as plastic foam. Preferred materials for use as foam core include polyurethane foam and polystyrene foam. In the preferred embodiment, layer 10 is an expanded polystyrene (EPS) core. Layer 10 has a thickness between 1.5 to 4 inch, and preferably a thickness of 2.5 inch. Layer 10 has a density in the range of 1.0 to 2.5 lb/ft$^3$, and preferably a density of 1.5 lb/ft$^3$. Alternatively, layer 10 can be polyurethane foam having a density in the range of 2.0 to 20 lb/ft$^3$, and preferably a density of 6 lb/ft$^3$. Expanded polystyrene bead foam core may be formed by expansion of pre-expanded polystyrene beads containing a blowing agent. Processes for making pre-expanded beads and molded expanded bead articles are taught in Plastic Foams, Part II, Frisch and Saunders, Marcel Dekker, Inc. (1973), which is incorporated herein by reference and well known. Polyurethane foam core may be formed by dispensing a chemical mixture of two components into a mold using a two component mixing head of a conventional polyurethane foam dispensing system. A conventional polyurethane system of isocyanate component and a polyol component may be applied to form the polyurethane foam core.

The first step of making the surfboard is molding the foam core. A foam core of selected material, preferably polystyrene foam, is molded and shaped to the desired board configuration. One or more longitudinal stringers 11 may be embedded inside the foam core 10 to improve the stiffness of the surfboard if desirable.

The foregoing process is known as a hot rolling lamination process because a film is extruded in a molten state onto a previously made material layer, whereon the film solidifies and adheres to by the pressure of nipping rollers. Hot rolling lamination is the preferred lamination process in the present invention. Hot melt resin may be applied to bond polyolefin foam sheet to plastic film or substrates of other plastic material using other lamination processes known in the art. Alternatively hot melt adhesive resin may be applied by liquid coating or spray coating method in which the hot melt resin is in the form of liquid-base adhesive solution. A hot melt resin coated plastic film may be formed with plastic film on one side and hot melt resin on the other side by using a conventional plastic co-extruder. The resulting co-extruded film is then heat laminated to the foam substrate.

Figure 2:
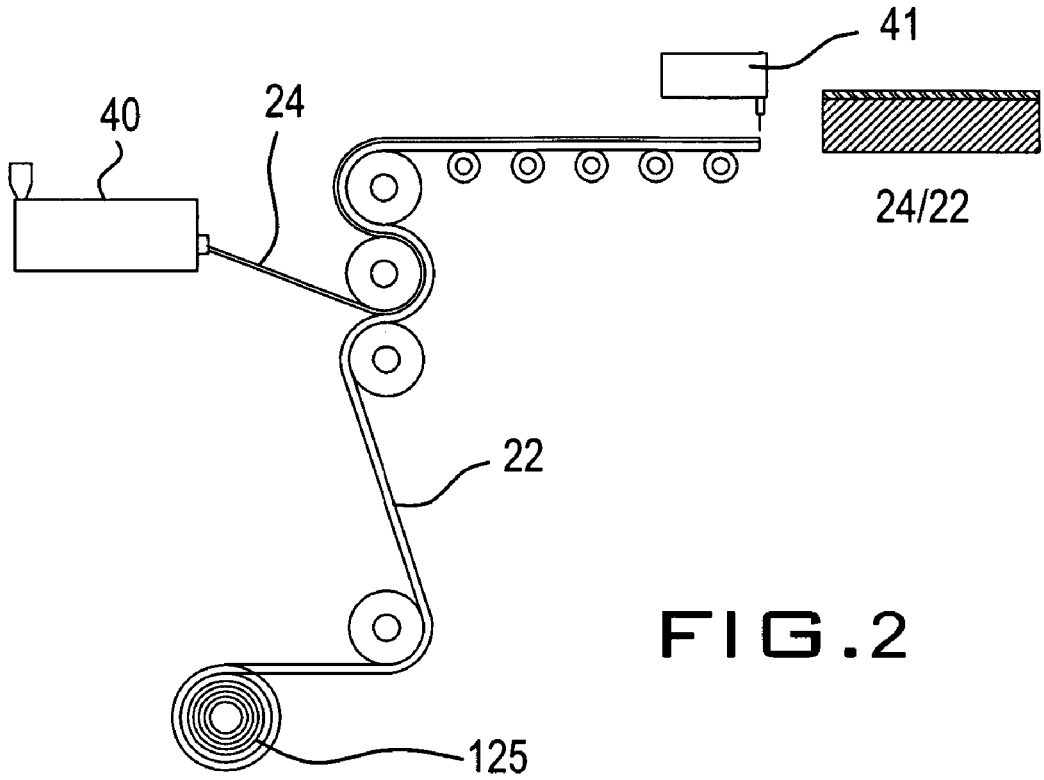
FIG. 2 is a schematic view of the extrusion heat laminating process to make a hot melt resin-coated polyethylene foam laminate of the surfboard top skin.
Figure 3:
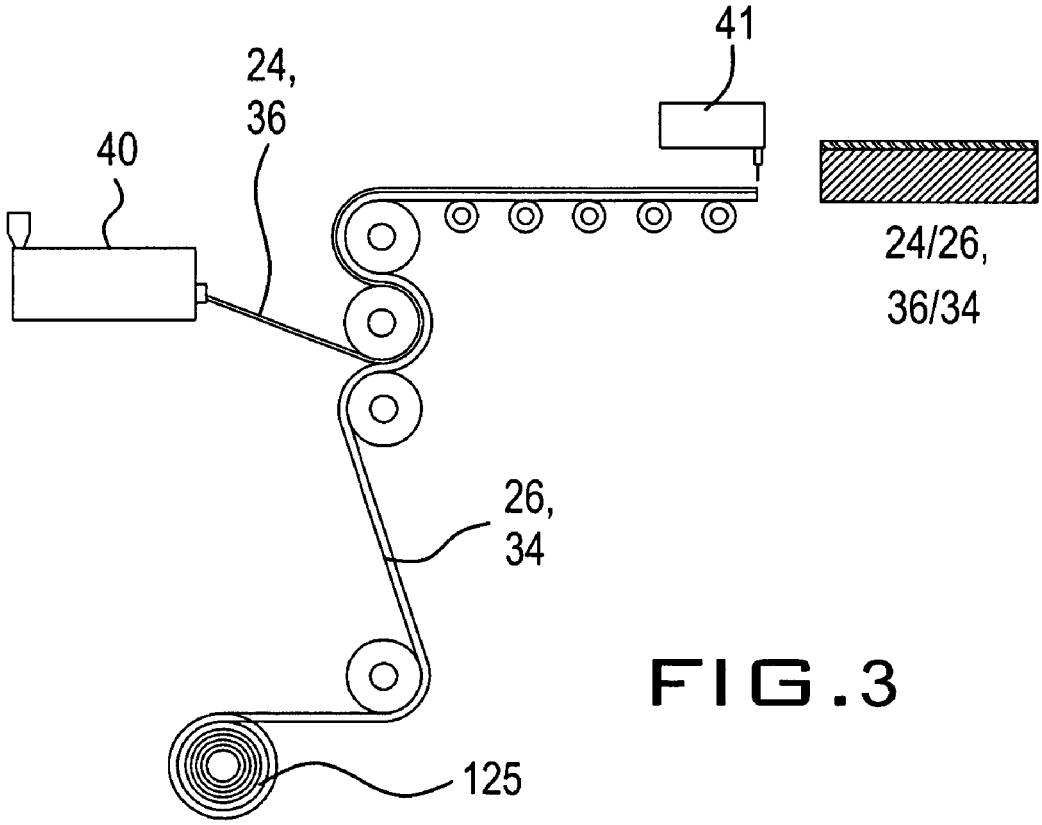
FIG. 3 is a schematic view of the extrusion heat laminating process to make a non-woven fabric layer with hot melt resin coating for both of the top and bottom skins.

Laminated top skin 12 is formed in a series of steps. Referring to FIG. 2, the hot melt resin layer 24 is first extruded using a conventional plastic extruder 40 to form a thin film and heat laminated to the polyethylene foam sheet 22, which is fed from a bottom roll 125. The resulting hot melt resin coated polyethylene foam laminate 24/22 is then subjected to a cutter 41 and configured to the desired shape. Similarly, the non-woven fabric layer 26 is also coated with hot melt resin layer 24 by the same extrusion heat laminating process and form the laminate 24/26 as shown in FIG. 3.

Figure 4:
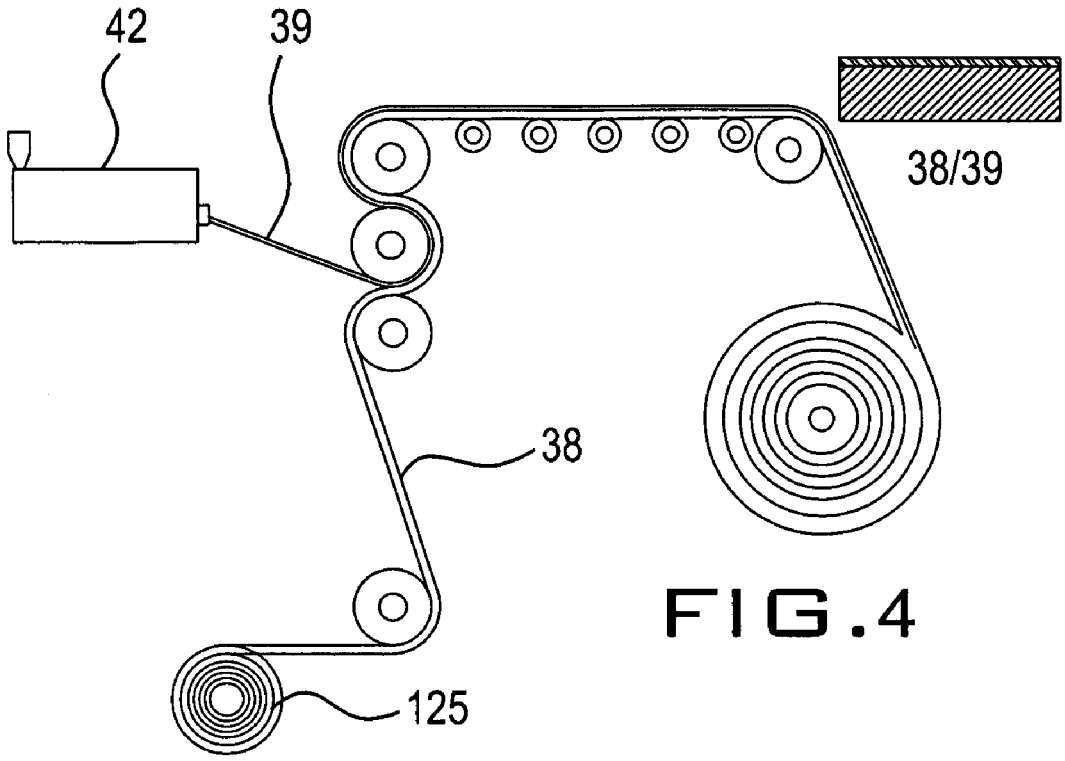
FIG. 4 is a schematic view of the extrusion heat laminating process showing the slick film is extruded and laminated onto the polyethylene foam sheet.
Figure 5:
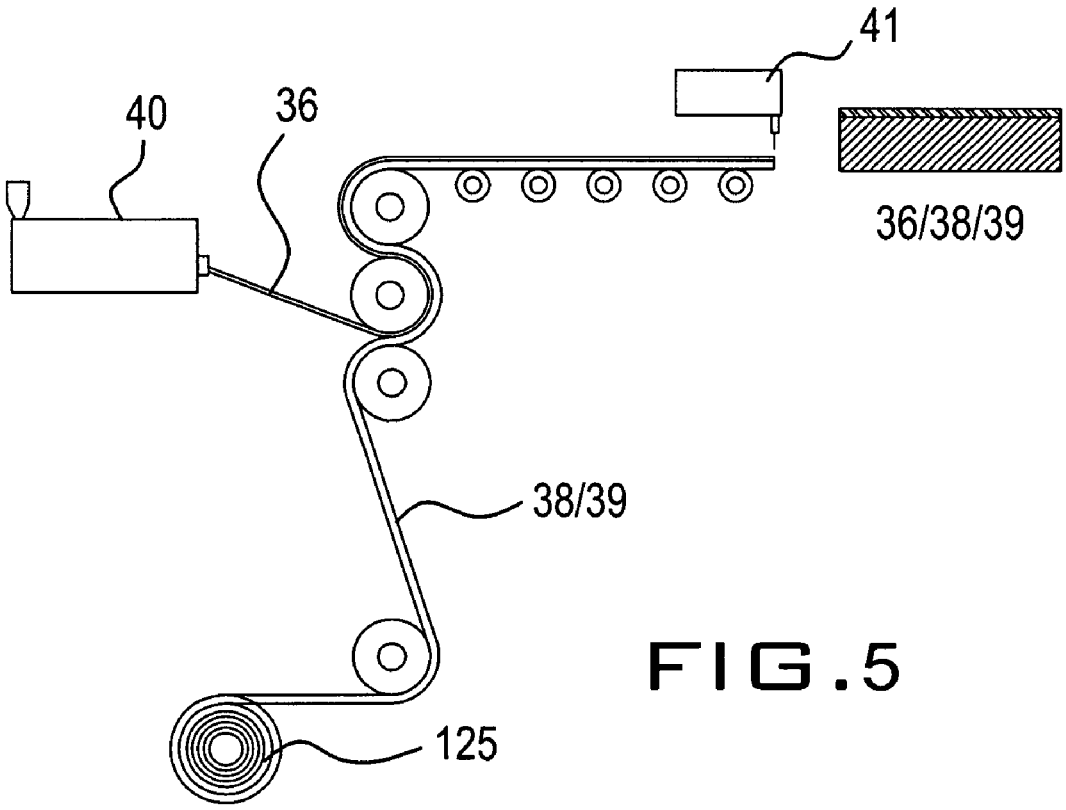
FIG. 5 shows the process of making a bottom laminate by coating the hot melt resin onto the laminate of FIG. 4.

Laminated bottom skin 13 is also formed in similar steps. Referring to FIG. 4, plastic slick film layer 39 is first extruded using a conventional plastic extruder 42 to form a thin film and heat laminated to the polyethylene foam sheet 38. The resulting laminate 38/39 is wound up for next step. Then, the laminate 38/39 is fed from a bottom roll 125 and hot melt resin layer 36 is extruded to form a thin film and heat laminated to the resulting laminate 38/39, forming a laminate 36/38/39 as shown in FIG. 5. Similarly, non-woven fabric layer 34 is also coated with hot melt resin layer 36 by the same extrusion heat laminating process and form the laminate 36/34 shown in FIG. 3.

After these laminates have been made, different layers are placed into a mold and suitable casting polymer resin is applied to the interface of these layers and different layers are bonded together by applying sufficient heat and pressure to cure the resin inside a mold. The process is well known in the industry as compression molding.

Different layers of the pre-made laminate are laid one on top of the other layer. For example, the sequence of placing the laminated layers for the first embodiment of the present invention is as follows: At first, place the laminate 36/34 of the bottom skin 13 on the bottom mold with the non-woven fabric 34 surface facing up. Wet the non-woven fabric 34 surface with epoxy resin, or other casting polymer resin known in the art. Lay reinforcement layer 32 on top of the non-woven fabric 34 and apply epoxy resin on the reinforcement layer 32 surface. Lay foam core 10 and apply epoxy resin to the foam core surface. Then lay reinforcement 28 of the top skin 12 and again wet the surface with epoxy resin. Lay the laminate 24/26 on top of the reinforcement layer 28 with the hot melt resin 24 surface facing up. After that close the top mold and pressure is applied to the mold by a ramp. Heat is generally applied to the mold for shortening the hardening time of epoxy resin.

After the epoxy has been hardened the molded article is taken from the mold and flash is trimmed off. After that the bottom laminate 38/39 that is heat laminated to the hot melt resin layer 36 covers the bottom surface of the surfboard. Similarly, the foam sheet laminate 22/24 with resilient and non-slip properties, such as polyethylene foam, is then heat laminated to the top surface and rail surfaces of the surfboard. A schematic diagram showing the heat lamination process is in FIG. 6.

This surfboard construction provides a surfboard that has a conventional fiberglass surfboard performance having a fiberglass reinforced high rigidity, a lightweight foam core and at the same time having a soft foam deck that is more comfortable for the surfer when paddling out to catch a wave. The soft foam deck also gives a surfer better grip of the board and thereby better control. This eliminates the need for waxing the deck to increase friction as in the case of hard surfboard.

Figure 7:
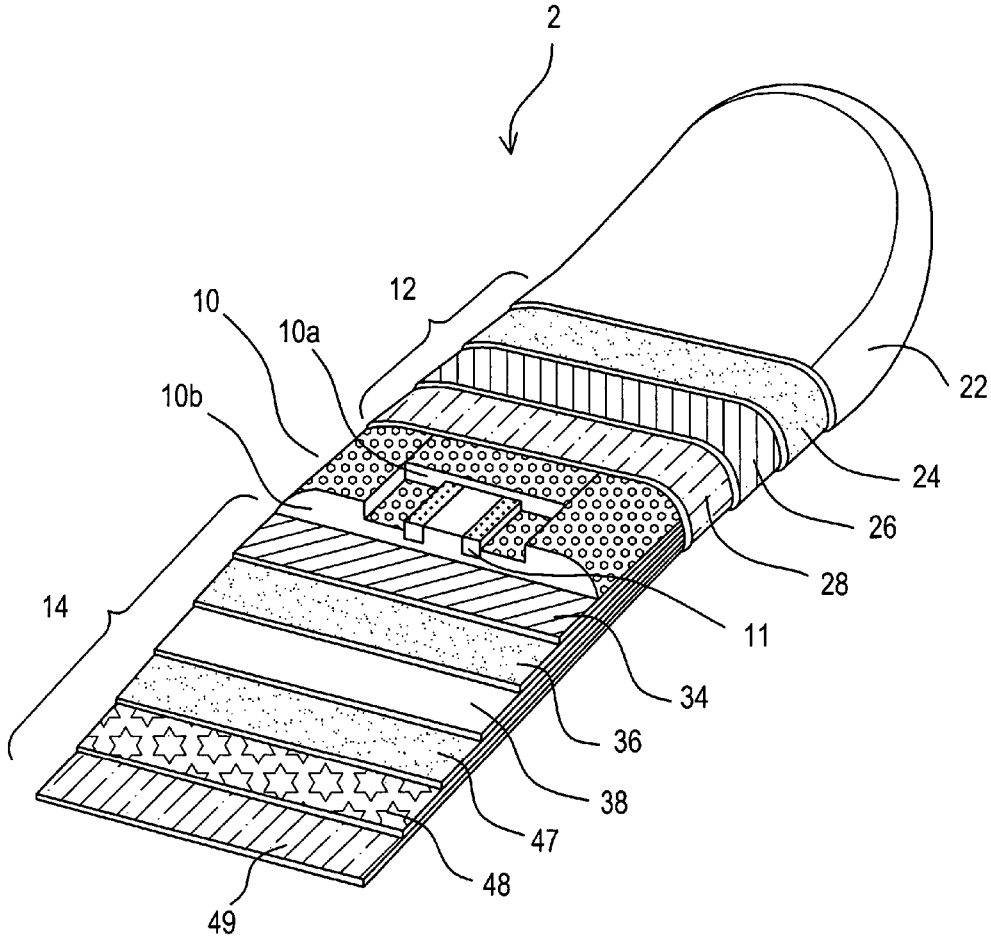
FIG. 7 is a partially exploded perspective view of a surfboard according to a second embodiment of the present invention.

In FIG. 7, an alternative bottom construction to that of the surfboard 1 of FIG. 1 may be applied to the surfboard 2. The laminated bottom skin may include a graphic imprinted fabric layer 48. A graphic image may be printed on the fabric layer 48 by any conventional printing method known in the art, including silk screen printing, heat transfer printing and sublimation printing. The fabric layer 48 can be any ink receptacle fabric including natural fabric, synthetic fabric, paper and non-woven fabric. In the preferred embodiment, graphic image is printed by silkscreen printing method on a synthetic fabric layer. In this second embodiment, the bottom skin 14 is constructed of six layers. In this particular embodiment, there is no reinforcing layer adhering to the foam core. Instead, the non-woven fabric layer 34 is bonded directly to the foam core. It is understood that a reinforcing layer such as fiberglass mat can be applied to increase the stiffness of the board if desirable. Layers 34, 36 and 38 are of the same structure and composition as layers 34, 36 and 38, respectively, of the first embodiment. Layer 47 is hot melt resin and is same as layer 36. Layer 48 is a spun-bonded polyester non-woven fabric having a mesh of between 30 to 150 g/m$^2$, and preferably a mesh of 80 g/m$^2$. Layer 49 is a reinforcing layer of fiberglass mat. Layer 49 has a mesh of between 150 to 700 g/m$^2$, and preferably a mesh of 250 g/m$^2$. Same as layer 32 of FIG. 1, desirable casting polymer resin, preferable epoxy resin, is applied to impregnate and strengthen the bottom construction.

Figure 8:
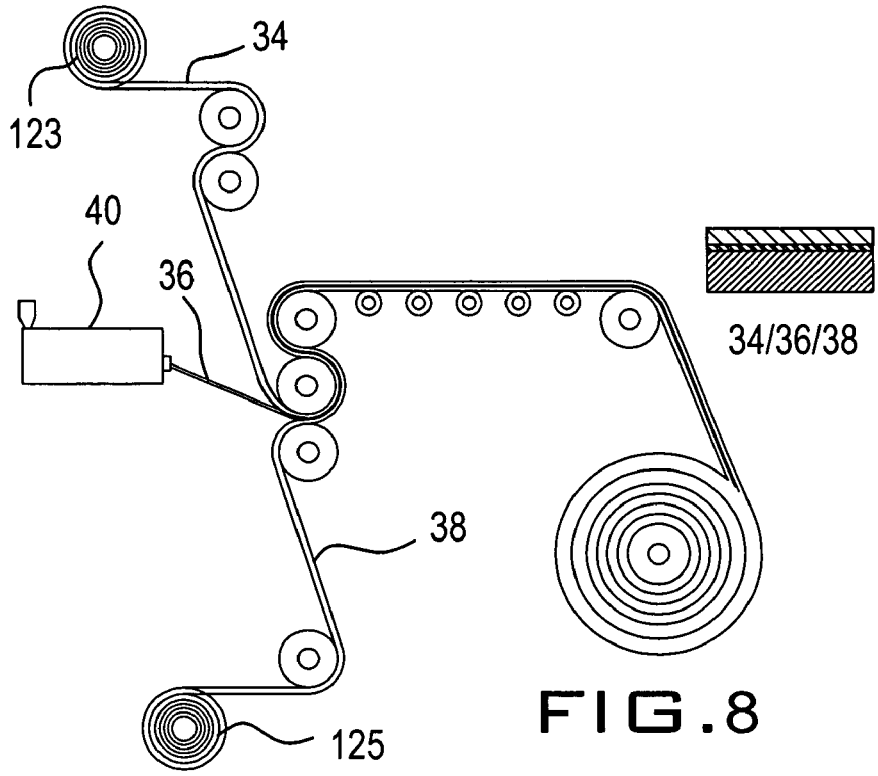
FIG. 8 shows the first half process of making the second embodiment laminated bottom skin.
Figure 9:
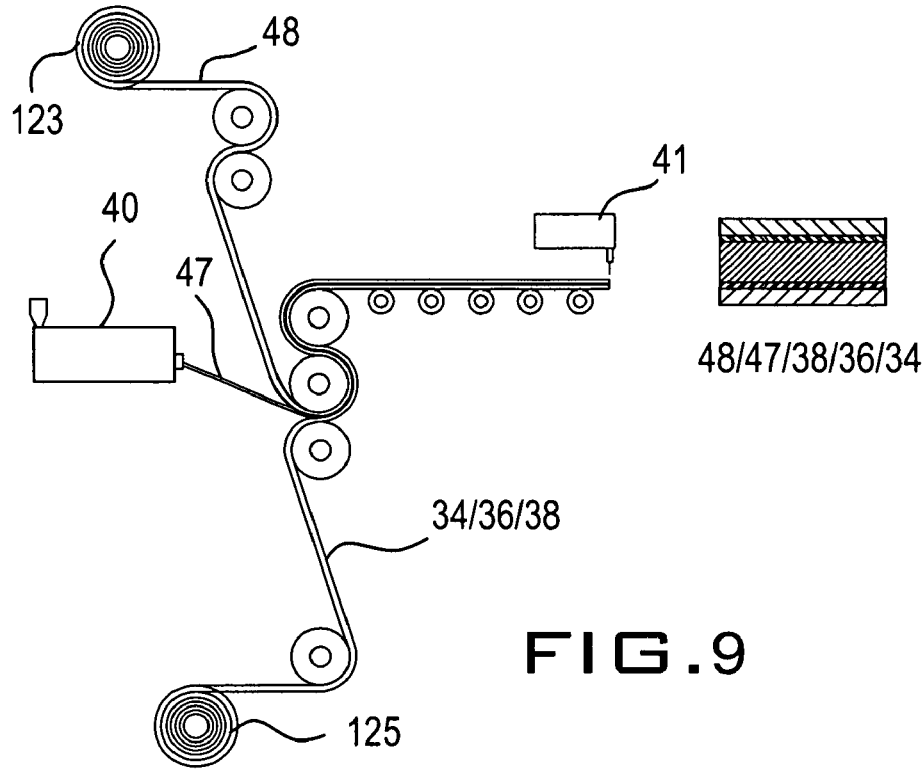
FIG. 9 shows the second half process of making the second embodiment laminated bottom skin.

Laminated bottom skin 14 is also formed in similar steps. Referring to FIG. 8, polyethylene foam sheet 38 is fed from a bottom roll 125 while non-woven fabric 34 is fed from a top roll 123. Hot melt resin layer 36 is extruded to form a thin film and heat laminated between the layer 34 and layer 38 to form a laminate 34/36/38. The resulting laminate is wound up for next step. Then, as shown in FIG. 9, the resulting laminate 34/36/38 is fed from a bottom roll 125 and printed fabric 48 is fed from a top roll 123. Hot melt resin layer 47 is extruded to form a thin film and heat laminated between the layer 34/36/38 and layer 48 to form a laminate 48/47/38/36/34. The resulting laminate 48/47/38/36/34 is then cut at a cutter 41 and configured to the desired shape. After these laminates have been made, the surfboard 2 is manufactured using similar compression molding process as described in the first embodiment.

Figure 10:
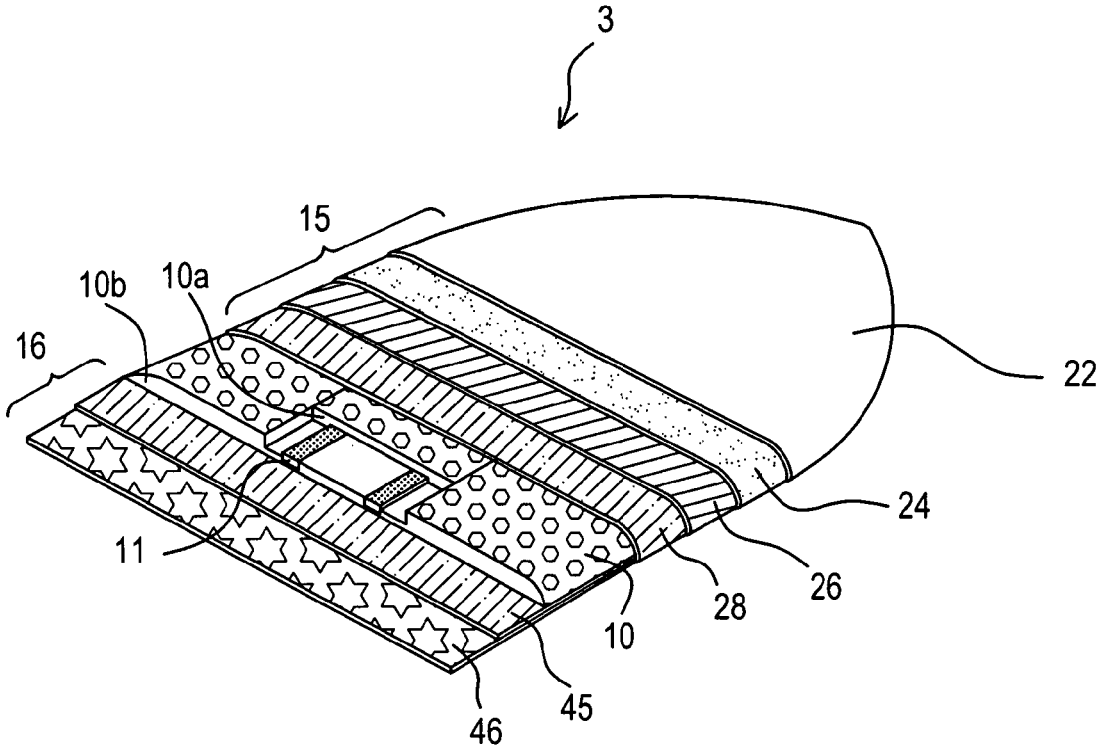
FIG. 10 is a partially exploded perspective view of a surfboard for use in skim boarding according to a third embodiment of the present invention.

FIG. 10 shows a third embodiment 3. In this embodiment, the board is a skimboard characterized by thinner board, more pointed head and may consist of fewer layers in the construction. This embodiment can be applied to skim boarding, wake surfing, wake boarding and wakeskate boarding. The skimboard preferably has a flatter bottom.

As illustrated in FIG. 10, the laminated top skin 15 construction is made up of four individual layers of material, an outermost layer of polyolefin foam skin 22, an intermediate hot melt resin layer 24 and two innermost layers 26 and 28, respectively. In this third embodiment, Layers 22, 24, 26 and 28 are of the same structure and composition as layers 22,24, 26 and 28, respectively, of the first embodiment 1. Layer 28 has a mesh of between 120 to 900 g/m$^2$, and preferably a mesh of 450 g/m$^2$.

Figure 6:
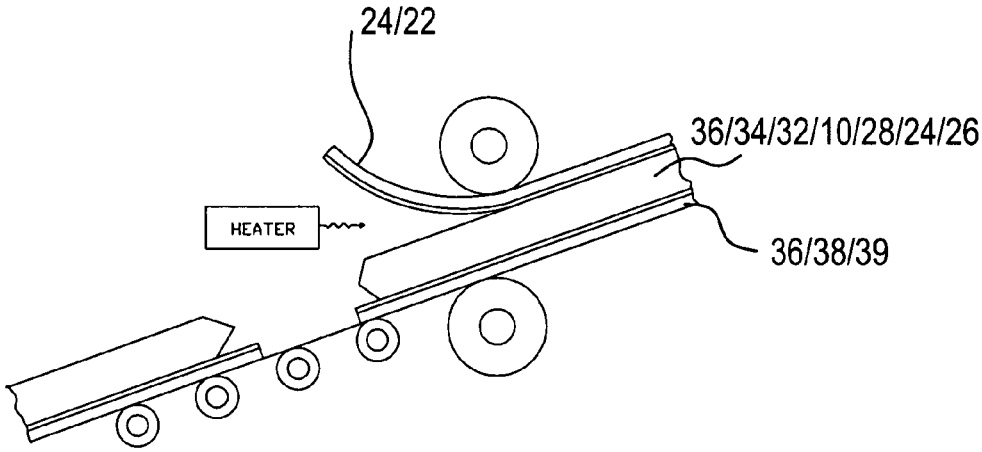
FIG. 6 is a schematic diagram showing the top foam sheet heat lamination process.

The laminated bottom skin 16 is constructed by two layers of material. In the preferred embodiment, Layer 45 is fiberglass mat having a mesh of between 80 to 800 g/m$^2$, and preferably a mesh of 300 g/m$^2$. Layer 46 is a spun-bonded polyester non-woven fabric having a mesh of between 30 to 150 g/m$^2$, and preferably a mesh of 80 g/m$^2$. Layer 46 may include graphic image printed thereon to decorate the board. Alternatively an additional reinforcing layer such as a fiberglass mat can be added to the outer surface of the printed fabric layer 46. Again the reinforcing layer is impregnated with a desirable thermosetting resin to bond them together. Similar to the manufacturing process of the first embodiment, various layers and laminates of board 3 are prepared and molded by compression molding. The top polyethylene foam sheet 22 is finally heat laminated to the resulting molded article, covering the top and rail surfaces of the board as schematically shown in FIG. 6.

Woven filament from fibers forms a woven fabric, and non-woven filament has filament randomly positioned to form a fabric sheet. Thermosetting resin is typically epoxy, polyester, AB glue or the like. Hot melt resin means a heat activated polymer resin that is typically a thin film of polymer that form good adhesion bonding with a substrate when the resin is heated to its thermoplastic state.

Additionally, an array of circular dimples can be added to the bottom of the board by hot pressing. The array of circular dimples changes fluid flow underneath the board. The fluid flow can be controlled by rider control over the composite midsection as described above.

Figure 12:
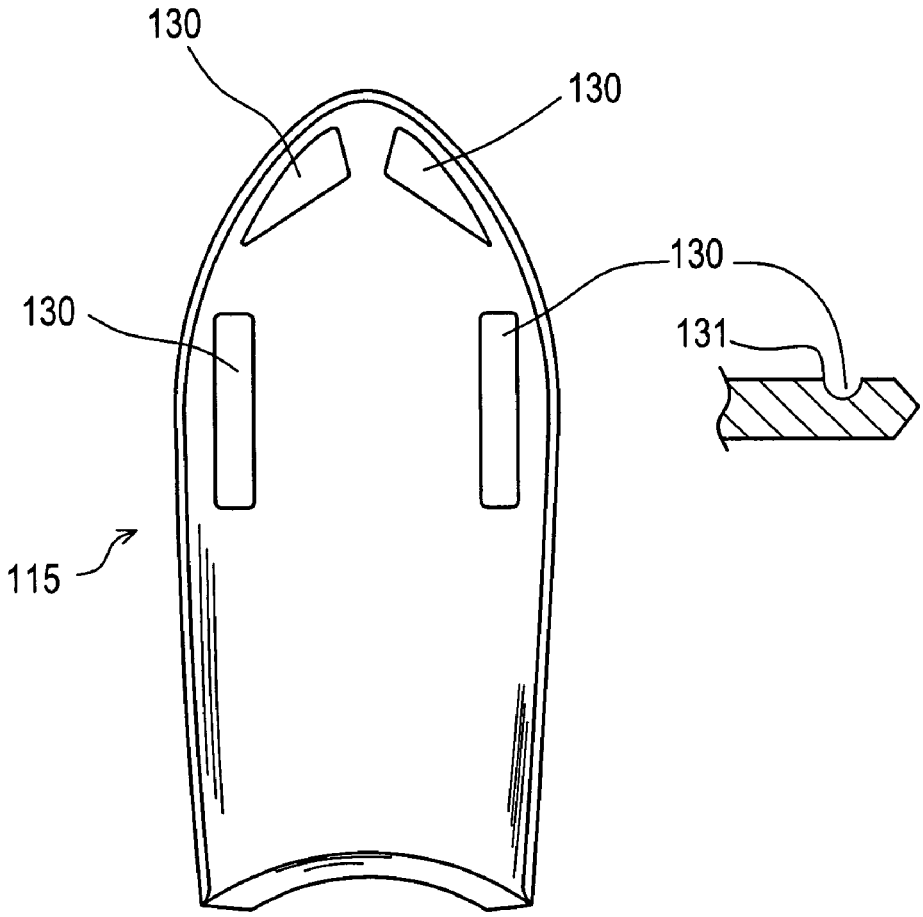
FIG. 12 is a top view of the present invention showing indentation grip.

Additionally, the sports board can include a plurality of ridges or slots disposed in the top of the board allowing a user to grasp the ridges 131 in a purchase enhancing region. The purchase enhancing region is generally disposed in the front of the board away from the midsection. A rider can grasp the ridges in the purchase enhancing region by disclosing a thumb upon the ridge to take better advantage of the composite midsection control described above. The foam board 115 is shown in FIG. 12 as having depressions formed on the top surface. The depressions 130 allow a user to grasp the edge of the board. The depressions may form a ridge 131 allowing better control of the board. The depressions, or slots can also be formed in the nose part of the board as well as the sides.

Figure 11:
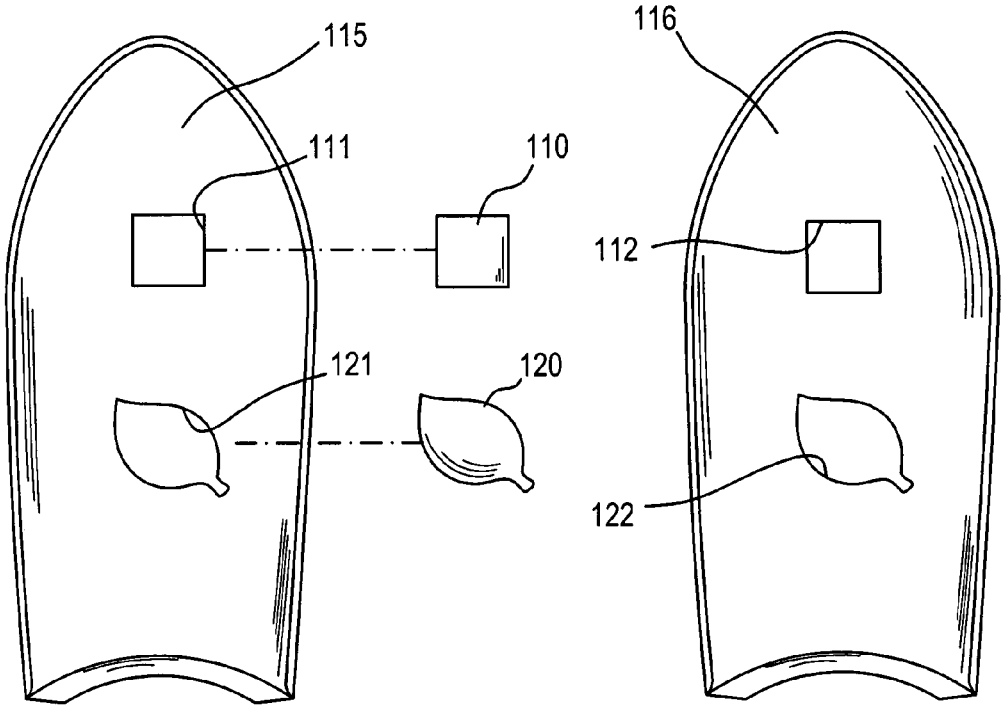
FIG. 11 is a top view of the present invention showing insert swapping.

FIG. 11 shows that portions of the sports board 115 can be cut out of the board as sections 110, 120. The sections are inserts that can be put in a second sports board 116 where the same cuts have been made. Typically, the second sports board 116 and the first sports board 115 have a different color so that different colorful patterns can be implemented by using the punch method. After an insert is inserted, the insert can be glued in place or similarly adhered.

A square punch cuts a square hole 111 in the sports board 115 and produces a square section 110. The cut opening formed in the top of the reinforcing layer receives an insert. A leaf shaped punch cuts a leaf shape hole 121 producing a leaf shaped section 120. The same square punch can punch a similarly sized square hole 112 in the second sports board 116. The second sports board 116 can thus receive the square section 110 from the first sports board 115. Similarly, the leaf shaped section 120 cut from aperture 121, can be put into aperture 122 of the second sports board. A variety of different designs can be made with this method. Where a stringer 11 is a found underneath the sports board 115, the punch can be adjusted so that it does not penetrate the stringer 11.

Additionally, although the polyethylene foam top skin covering the sports board of the present invention provides improved frictional riding surface, it is even more desirable to provide grip enhanced region which may include ridges, grooves and other contoured gripping pattern for further improving frictional force between rider and the top skin of the sports board. It is therefore an objective of the present invention to provide a foam deck sports board with a riding surface that includes a contoured pattern for enhancing gripping of the rider.

The desirable gripping pattern may be formed on the polyolefin foam top skin by heating the foam skin to its softening temperature and pressed by a mold having the desirable pattern thereon. The manufacturing process is well known in the industry as thermoforming process. Furthermore the polyolefin foam top skin may include one or more inlay design defined by an inlay aperture formed entirely within the laminate skin dimensioned to receive a congruent insert. The inlay inserts may also have gripping pattern formed by the above mentioned thermoforming process. Typically, the inlay inserts have a different color from the main foam top skin. The gripping pattern provides improved frictional riding surface and aesthetic appearance to the board.

Therefore, while the presently preferred forms of the composite surfboard have been shown and described, and several modifications thereof discussed, persons skilled in this art will readily appreciate that various additional changes and modifications may be made without departing from the spirit of the invention, as defined and differentiated by the following claims.

Call Out List of Elements

1, 2: Surfboard
3: Skimboard
10: Foam Core
10*a*: Upper Foam Core
10*b*: Lower Foam Core
11: Stringer
12: Laminated Top Skin
13: Laminated Bottom Skin
22, 38: Polyethylene Foam Sheet
24, 36: Hot Melt Resin
24/22: Foam Sheet Laminate
26, 34: Non-woven Fabric
28, 32: Fiberglass Reinforcement
36/38/39: Bottom Laminate
36/34/32/10/28/24/26: Molded Article
39: Plastic Slick Film
40, 42: Extruder
41: Cutter
45: Graphic Imprinted Fabric Layer
47: Hot Melt Resin
48: Reinforcement Laminate
125: Bottom Roll

The invention claimed is:

1. A sports board having a rider supporting region comprising:

a. a longitudinally extending foam core having a top surface, a bottom surface and rail surfaces;

b. a top laminate bonded to the top surface and rail surfaces;

c. a bottom laminate bonded to the bottom surface; and d. at least one of the top laminate or bottom laminate comprising:

a polyolefin foam layer having an inner surface and outer surface; and a non-woven fabric layer having a first surface and a second surface opposed to the first surface; wherein hot melt resin bonds the first surface to the inner surface of the polyolefin foam; wherein thermosetting resin bonds the non-woven fabric layer to the core.

2. The sports board of claim 1, wherein the board is a substantially flat bottom skimboard or wakesurfer.

3. The sports board of claim 2, further comprising a stringer reinforcement disposed along the length of the board.

4. The sports board of claim 1, further comprising a stringer reinforcement disposed along the length of the board.

5. The sports board of claim 1, further comprises a plurality of ridges formed on the rider-supporting region of the polyolefin foam topskin.

6. The sports board of claim 1, further comprises an inlay aperture formed within the laminate skin dimensioned to receive a congruent inlay insert.

7. A soft deck sports board for surfing or gliding over water or snow comprising:

a. a longitudinally extending foam core having a top surface, a bottom surface and rail surfaces;

b. a top laminate bonded to the top surface and rail surfaces;

c. a bottom laminate bonded to the bottom surface; and d. at least one of the top laminate or bottom laminate comprising:

a polyolefin foam layer having an inner surface and outer surface; and a non-woven fabric layer having a first surface and a second surface opposed to the first surface; wherein hot melt resin bonds the first surface to the inner surface of the polyolefin foam; wherein thermosetting resin bonds the non-woven fabric layer to the core;

wherein the sports board is made by the steps of:

providing an elongated foam core having a top surface, a bottom surface and rail surfaces;

applying a hot melt resin layer on a polyolefin foam laminate and on a non-woven fabric layer to form a top laminate to cover the top surface and rail surfaces;

applying a hot melt resin layer on a laminate of polyolefin foam sheet and on a non-woven fabric layer for making a laminated bottom skin to cover the bottom surface of the foam core;

compression molding to bond the foam core and different layers of the laminates in a mold;

trimming the flash of the molded article retrieved from the mold;

heat laminating the bottom laminate of the laminated bottom skin onto the bottom surface of the molded article; and heat laminating the foam sheet laminate onto the top surface and rail surfaces of the molded article to complete the sports board.

8. The soft deck sports board made by the method of claim 7, having a rider supporting region wherein the step of compression molding to bond the foam core and different layers of the laminates in a mold further comprises the substep of: first placing the hot melt resin coated non-woven fabric layer of the laminated bottom skin with its non-adhesive surface facing up.

9. The soft deck sports board made by the method of claim 7, wherein the step of compression molding to bond the foam core and different layers of the laminates in a mold further comprises the substep of: wetting the non-woven fabric surface with thermosetting resin and laying a reinforcement layer on top of the non-woven fabric and applying thermosetting resin on the reinforcement layer surface.

10. The soft deck sports board made by the method of claim 7, wherein the step of compression molding to bond the foam core and different layers of the laminates in a mold further comprises the substep of: laying the foam core and applying thermosetting resin to the foam core surface then laying another reinforcement layer and again wetting its top surface with epoxy resin and laying the hot melt resin coated non-woven fabric layer of the top laminate on top of the reinforcement layer.

11. The soft deck sports board made by the method of claim 8 wherein the step of compression molding to bond the foam core and different layers of the laminates in a mold further comprises the substep of: wetting the non-woven fabric surface with thermosetting resin and laying a reinforcement layer on top of the non-woven fabric and applying thermosetting resin on the reinforcement layer surface; wherein the step of compression molding to bond the foam core and different layers of the laminates in a mold further comprises the substep of: laying the foam core and applying thermosetting resin to the foam core surface then laying another reinforcement layer and again wetting its top surface with epoxy resin and laying the hot melt resin coated non-woven fabric layer of the top laminate on top of the reinforcement layer.

12. The soft deck sports board made by the method of claim 8 wherein the sports board additionally has ridges on the top laminate.

13. The soft deck sports board made by the method of claim 8 wherein the sports board additionally has grooves on the top laminate.

* * * * *